US006691325B1

(12) United States Patent
Pelletier et al.

(10) Patent No.: US 6,691,325 B1
(45) Date of Patent: Feb. 17, 2004

(54) HELMET FOR A RACE DRIVER

(75) Inventors: Richard Pelletier, Thousand Oaks, CA (US); Soren Petersen, South Pasadena, CA (US); Juergen Bruegl, Los Altos, CA (US); Oliver Schimpf, Braunschweig (DE)

(73) Assignee: Bayerische Motoren Werke AG, Munich (DE)

( * ) Notice: Subject to any disclaimer, the term of this patent is extended or adjusted under 35 U.S.C. 154(b) by 0 days.

(21) Appl. No.: 10/255,088

(22) Filed: Sep. 26, 2002

(51) Int. Cl.[7] ..... A63B 71/10; A42B 1/24
(52) U.S. Cl. ..... 2/425; 2/422; 2/424; 224/181
(58) Field of Search ..... 2/425, 424, 422, 2/410, 6.2; 224/181

(56) References Cited

U.S. PATENT DOCUMENTS 1,409,808 A * 3/1922 Wood ..... 2/422
5,034,747 A * 7/1991 Donahue ..... 2/410
6,545,822 B2 * 4/2003 Longobardi et al. ..... 2/422

* cited by examiner

*Primary Examiner*—Rodney M. Lindsey
(74) *Attorney, Agent, or Firm*—Crowell & Moring LLP

(57) ABSTRACT

A helmet, particularly a racing driver helmet for motorcycle drivers or automobile drivers, has a helmet shell which is lined on its interior side with a shock-absorbing material and which has a recess which forms a field of view for the wearer of the helmet, and has a chin bow extending below the field of view. On the interior side of the chin bow at least one pot-shaped recess is provided for receiving an indicating device.

23 Claims, 4 Drawing Sheets

HELMET FOR A RACE DRIVER

BACKGROUND AND SUMMARY OF THE INVENTION

The present invention relates to a helmet for racing motorcycle or automobile drivers.

Helmets with indicating devices, particularly displays, are known from motor racing and from the aircraft field. Indicating devices in the case of helmets must necessarily be arranged in the driver's field of view, which may represent a potential risk factor.

It is an object of the invention to provide a helmet, particularly a racing driver helmet for motorcycle drivers or automobile drivers, which is equipped with an indicating device and nevertheless offers a high degree of safety.

The invention is based on a helmet having a helmet shell which is lined with a shock-absorbing material, such as a foamed material, on its interior side and which has a recess forming a field of view for the driver. A chin bow is provided below this recess of the helmet shell.

The basic principle of the invention consists of providing at least one pot-shaped recess on the interior side of the chin bow. The pot-shaped recess is provided for receiving an indicating device. More precisely, an indicating device can be inserted into the pot-shaped recess, which indicating device will then project slightly in the upward direction out of the pot-shaped recess. The indicating device has an indicating field in which the helmet wearer can read information. The pot-shaped recess preferably consists of a dimensionally stable material and is open toward the top.

According to a further development of the invention, the pot-shaped recess is arranged eccentrically with respect to the helmet. The recess is preferably arranged in the area below the helmet wearer's right eye or left eye. An indicating device inserted into the pot-shaped recess can therefore be read without effort.

According to a further development of the invention, two such pot-shaped recesses are provided, specifically one in the area of the helmet wearer's right eye and the other in the area of the helmet wearer's left eye.

The pot-shaped recess may, for example, be made of a fiber layer material, such as aramide fibers. A very well known material suitable for this purpose is sold under the trade name of KEVLAR.

Since the pot-shaped recess is made of a relatively hard or dimensionally stable material, it is covered by a layer of elastic material, such as elastic foam, toward the inside of the helmet or the helmet wearer's chin. If, as described above, two such pot-shaped recesses are provided, the area between the two recesses, that is, the center area of the chin bow, may also be filled with such an elastic material or elastic foam. In addition, the side areas of the pot-shaped recesses may be covered by means of such an elastic material. In particular, the entire interior part of the chin bow in the area of the pot-shaped recesses may be coated with such an elastic material. A skin-friendly layer is preferably applied to the elastic material, which skin-friendly layer consists of a still softer material and directly faces the helmet wearer's chin.

In the following, the invention will be explained in detail by means of an embodiment in connection with the drawing.

BRIEF DESCRIPTION OF THE DRAWING FIGURES

DETAILED DESCRIPTION OF THE DRAWING FIGURES

Figure 1:
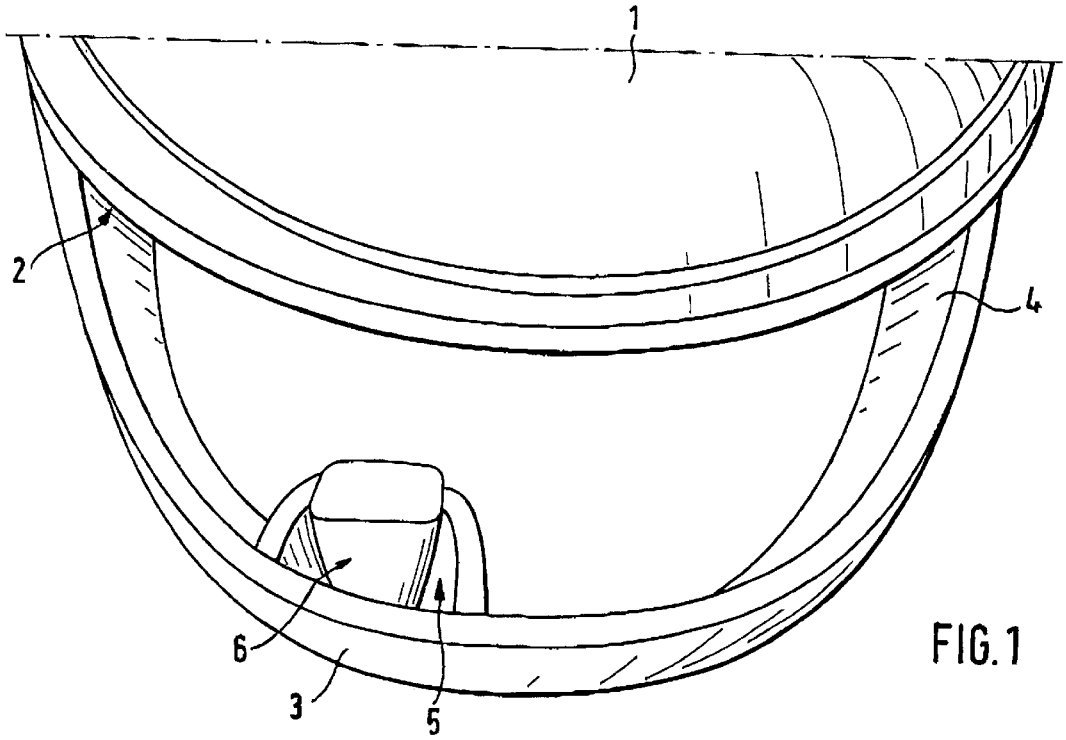
FIG. 1 is a top view of the basic principle of a helmet with a pot-shaped recess for receiving the indicating device.
Figure 2:
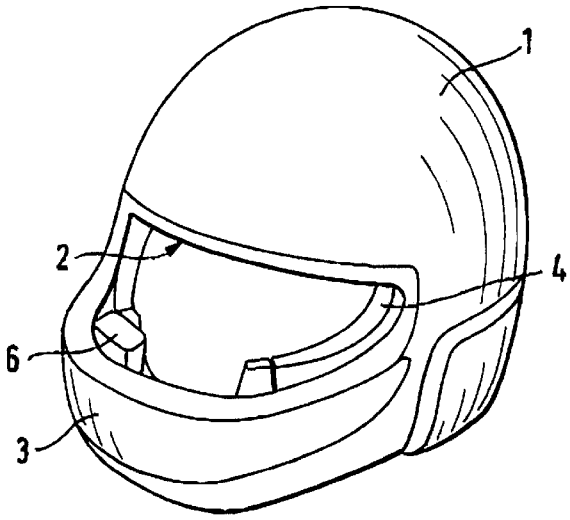
FIG. 2 is a perspective view from the left front of the helmet of FIG. 1.

FIGS. 1 and 2 show a racing driver helmet having a helmet shell 1 which has a recess 2 forming a field of view for the wearer of the helmet. Below the recess 2, a chin bow 3 is provided which, in this case, is an integral component of the helmet shell. As an alternative, the chin bow may be swivellable relative to the helmet shell 1. As in the case of conventional motorcycle or race car driver helmets, the helmet shell is lined with a shock-absorbing material 4 on its interior side.

In contrast to conventional racing driver helmets, the helmet of FIGS. 1 and 2 has a pot-shaped recess 5 which is open toward the top on the interior side of the chin bow. The pot-shaped recess 5 may be made of a dimensionally stable material, such as a fiber material. An indicating device 6 is inserted into the pot-shaped recess 5, which indicating device 6 has a display on the side facing the wearer of the helmet.

As illustrated in FIGS. 1 and 2, the pot-shaped recess 5 and the indicating device 6 projecting upward from the pot-shaped recess 5 are arranged eccentrically at the chin bow 3. More precisely, the pot-shaped recess 5 is arranged in the area of the helmet wearer's right eye on the interior side of the chin bow 3. The helmet wearer can therefore read the display of the indicating device with his right eye without effort.

Figure 3:
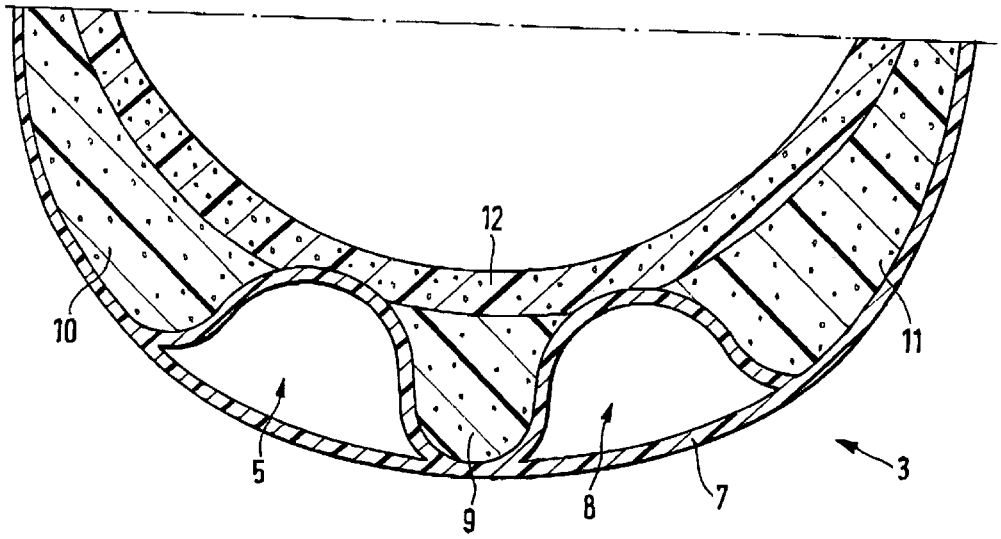
FIG. 3 is a schematic representation of the construction of the helmet in the area of the chin bow.

FIG. 3 shows the basic construction of the chin bow 3 of the helmet illustrated in FIG. 1. The helmet shell 1 (shown in FIG. 1) changes in one piece into a chin bow section 7 which consists of a hard plastic material, as known from conventional helmets. On the interior side of the chin bow section 7, two pot-shaped recesses 5, 8 are provided which are open toward the top. The pot-shaped recesses may be made, for example, of a fiber-reinforced plastic material. The aramide fiber material known by the trademark name KEVLAR, for example, is suitable for use as the material. The pot-shaped recesses are therefore relatively dimensionally stable. One layer 9, 10, and 11 is applied, respectively, to the area 9 between the two pot-shaped recesses 5, 8 as well as to the lateral area 10 next to the pot-shaped recess 5 and the lateral area 11 next to the pot-shaped recess 8. The layer 9, 10, and 11 consists of an elastic shock-absorbing material, for example, of an elastic shock-absorbing synthetic foam which has a shock-absorbing effect in the event of an impact to the chin of the helmet wearer. Along the entire width of the chin bow section 7, a thin layer 12 is applied to the elastic material 9, 10, and 11. The thin layer 12 may, for example, also be made of synthetic foam and is softer than the layer 9, 10, and 11. This thin layer 12 may also be called a "comfort layer" and should be soft and skin-friendly because the helmet wearer will contact it repeatedly with his chin.

Figure 4:
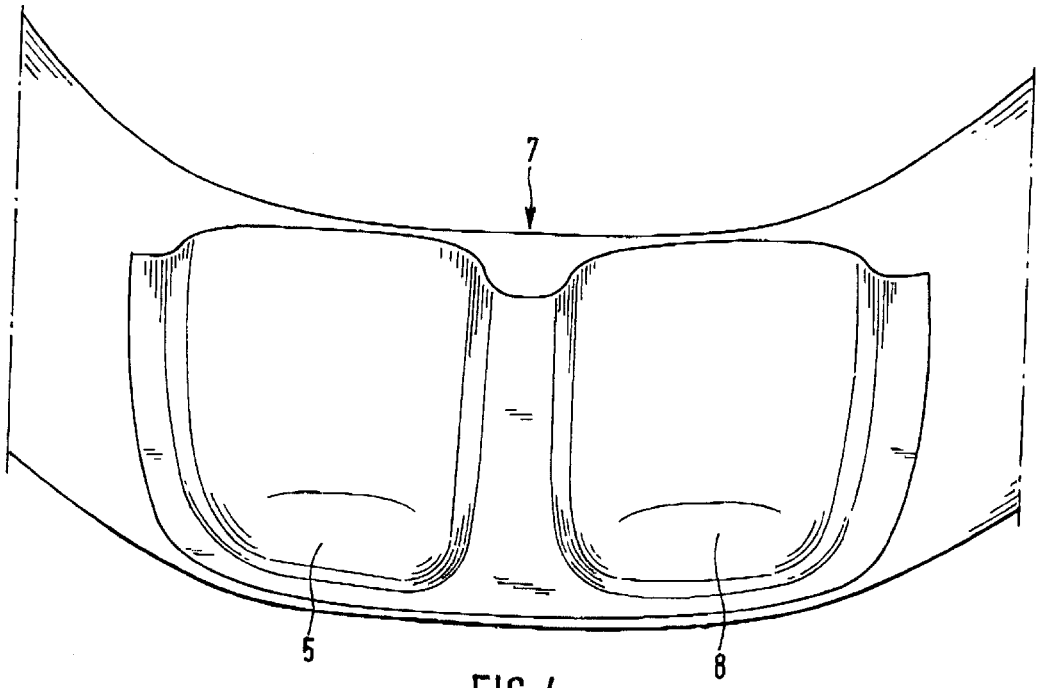
FIG. 4 is a sectional representation of a chin bow viewed from the interior of the helmet.

FIG. 4 is a view of the chin bow section 7 from the interior. The two pot-shaped recesses 5, 8 are shown which are molded of a fiber-reinforced plastic material and which are visible in FIG. 4 diagonally from the bottom, that is, from their closed side.

Figure 5:
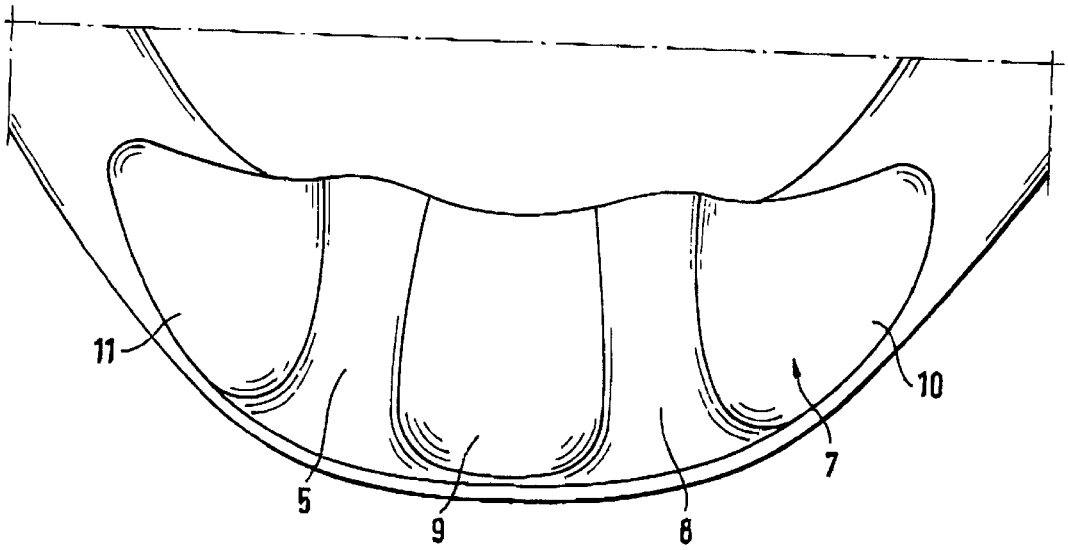
FIG. 5 is a view of the elastic foam provided between the pot-shaped recesses and laterally thereof.

FIG. 5 is a view of the chin bow section 7 of the helmet from the interior after another manufacturing step. After this manufacturing step, the space between the two pot-shaped recesses 5, 8 and the lateral areas next to the pot-shaped recesses are in each case filled or covered with an elastic foam material 9, 10, and 11.

Figure 6:
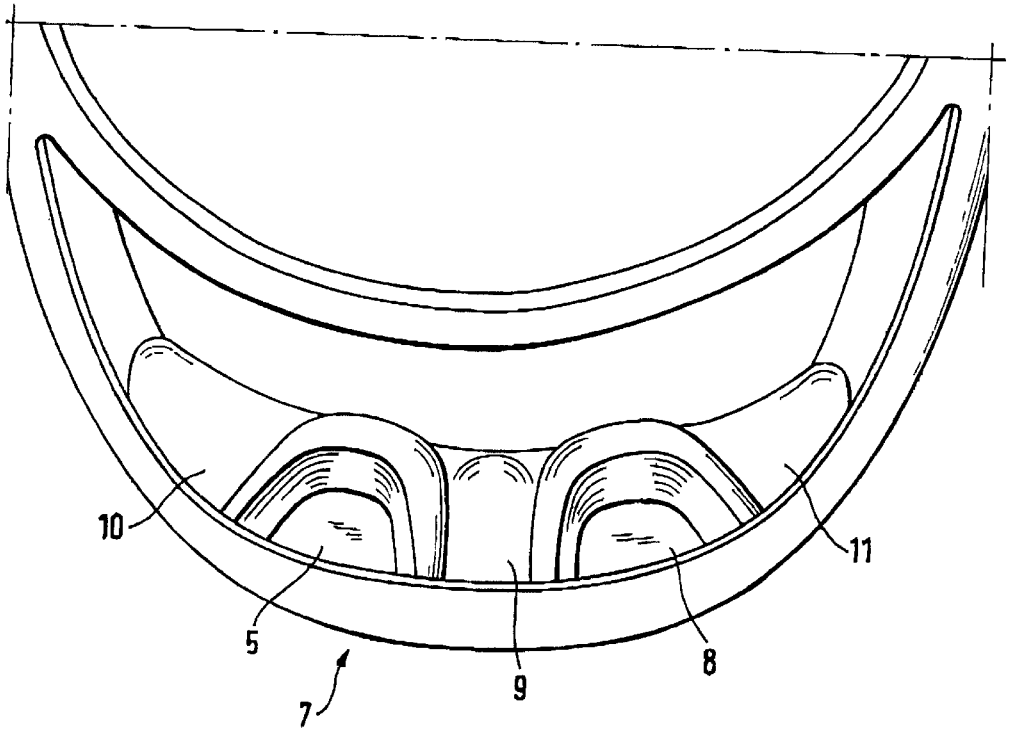
FIG. 6 is a representation similar to FIG. 5 but viewed from above.

FIG. 6 is a view of the chin section 7 shown in FIG. 5, viewed from the outside and diagonally from the top. It is clearly illustrated here that the pot-shaped recesses 5, 8 are open toward the top. The elastic shock-absorbing material 9, 10, and 11 fills the area between the two pot-shaped recesses 5, 8 as well as the adjoining side areas.

Figure 7:
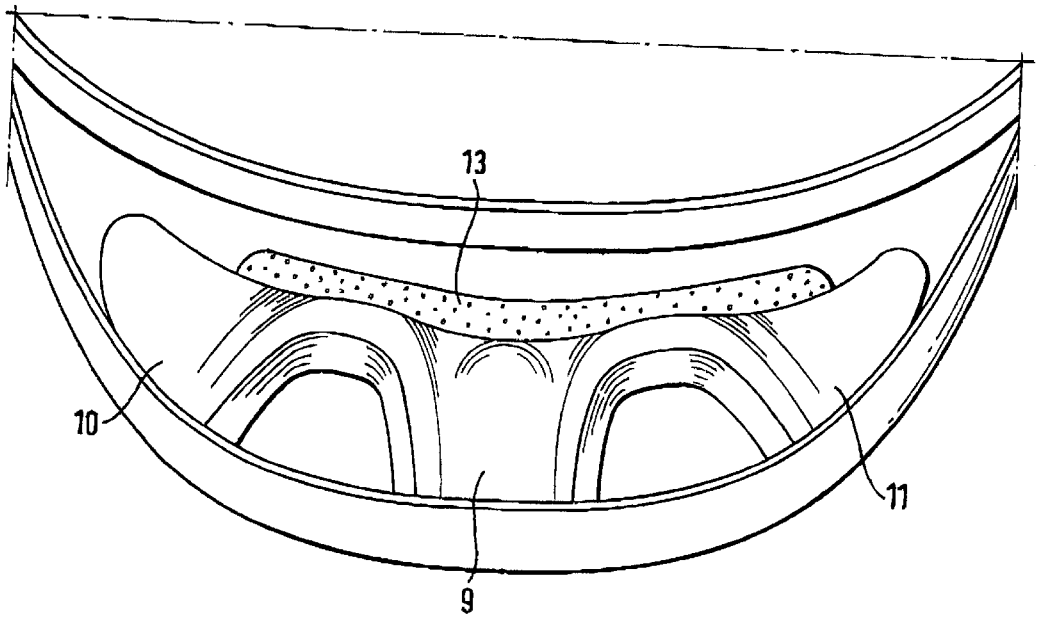
FIG. 7 is a view similar to FIG. 6, in which an embodiment has a soft layer applied to the elastic foam.

FIG. 7 shows the chin bow after another manufacturing step. An additional layer 13 is applied to the elastic material 9, 10, and 11 on the interior side, that is, on the side facing the chin of the wearer of the helmet. Here, the additional layer 13 consists of a soft foam material which is softer than the elastic material 9, 10, and 11 and forms a "comfort layer".

What is claimed is:

1. A helmet, particularly a racing driver helmet for motorcycle drivers or automobile drivers, comprising:

a helmet shell which is lined on an interior side with a shock-absorbing material and which has a recess which forms a field of view for a wearer of the helmet; and a chin bow extending below the field of view, wherein on an interior side of the chin bow at least one pot-shaped recess is provided for receiving a display device.

2. A helmet according to claim 1, wherein the recess is open toward a top side of the helmet.

3. A helmet according to claim 1, further comprising a display device inserted into the pot-shaped recess, wherein the display device projects upward out of the pot-shaped recess and has a display field in the field of view of the wearer of the helmet below a helmet wearer's eye and above the chin bow.

4. A helmet according to claim 2, further comprising a display device inserted into the pot-shaped recess, wherein the display device projects upward out of the pot-shaped recess and has a display field in the field of view of the wearer of the helmet below a helmet wearer's eye and above the chin bow.

5. A helmet according to claim 1, wherein the pot-shaped recess is arranged eccentrically in an area below the helmet wearer's right or left eye.

6. A helmet according to claim 2, wherein the pot-shaped recess is arranged eccentrically in an area below the helmet wearer's right or left eye.

7. A helmet according to claim 3, wherein the pot-shaped recess is arranged eccentrically in an area below the helmet wearer's right or left eye.

8. A helmet according to claim 5, wherein the pot-shaped recess is formed of a dimensionally-stable material.

9. A helmet according to claim 1, wherein the at least one pot-shaped recess on the interior side of the chin bow are below the helmet wearer's right eye and left eye respectively.

10. A helmet according to claim 3, wherein the at least one pot-shaped recess on the interior side of the chin bow are below the helmet wearer's right eye and left eye respectively.

11. A helmet according to claim 1, wherein the pot-shaped recess is formed by a fiber layer material.

12. A helmet according to claim 3, wherein the pot-shaped recess is formed by a fiber layer material.

13. A helmet according to claim 10, wherein the pot-shaped recess is formed by a fiber layer material.

14. A helmet according to claim 11, wherein the fiber layer material is an aramide fiber material.

15. A helmet according to claim 1, wherein the pot-shaped recess is covered by a layer of elastic material in the direction of an interior of the helmet or of a helmet wearer's chin.

16. A helmet according to claim 9, wherein the area between the two pot-shaped recesses and areas lateral of the two pot-shaped recesses are covered by a layer of elastic material.

17. A helmet according to claim 15, wherein the layer of elastic material is covered by a still softer layer in the direction of the helmet or the helmet wearer's chin.

18. A helmet according to claim 14, wherein the layer of elastic material is covered by a still softer layer in the direction of the helmet or the helmet wearer's chin.

19. A helmet according to claim 15, wherein the layer of elastic material is a synthetic foam.

20. A helmet according to claim 16, wherein the layer of elastic material is a synthetic foam.

21. A helmet according to claim 17, wherein the still softer layer is a synthetic foam.

22. A helmet according to claim 18, wherein the still softer layer is a synthetic foam.

23. A helmet according to claim 1, wherein the chin bow is swivellably connected with the helmet shell.

* * * * *